US009109352B1

(12) United States Patent
Knudson

(10) Patent No.: US 9,109,352 B1
(45) Date of Patent: Aug. 18, 2015

(54) METAL BUILDING SYSTEM

(71) Applicant: Gary A. Knudson, Oak Creek, CO (US)

(72) Inventor: Gary A. Knudson, Oak Creek, CO (US)

( * ) Notice: Subject to any disclaimer, the term of this patent is extended or adjusted under 35 U.S.C. 154(b) by 0 days.

(21) Appl. No.: 14/210,520

(22) Filed: Mar. 14, 2014

(51) Int. Cl.

| | |
|---|---|
| ***E04H 12/10*** | (2006.01) |
| ***E04H 12/08*** | (2006.01) |
| ***E04B 1/19*** | (2006.01) |
| ***E04B 1/24*** | (2006.01) |
| ***E04B 1/08*** | (2006.01) |

(52) U.S. Cl.
CPC ... *E04B 1/19* (2013.01); *E04B 1/08* (2013.01); *E04B 1/24* (2013.01); *E04B 1/2403* (2013.01); *E04B 1/1903* (2013.01); *E04B 2001/199* (2013.01); *E04B 2001/1975* (2013.01); *E04B 2001/1993* (2013.01); *E04B 2001/2481* (2013.01)

(58) Field of Classification Search
CPC . E04B 2001/2415; E04B 1/19; E04B 1/1903; E04B 2001/1975; E04B 2001/2406; E04B 2001/249; E04B 2001/2448; E04H 12/10; E04H 12/08
USPC ..... 52/650.2, 637, 634, 636, 643
See application file for complete search history.

(56) References Cited

U.S. PATENT DOCUMENTS

| | | | | | |
|---|---|---|---|---|---|
| 2,457,086 | A | * | 12/1948 | Mitchell et al. | 52/377 |
| 2,617,179 | A | * | 11/1952 | Burke | 29/897.35 |
| 2,933,056 | A | | 11/1954 | Martin | |
| 3,157,251 | A | * | 11/1964 | Rasch | 52/93.1 |
| 3,190,404 | A | * | 6/1965 | Greulich | 52/90.1 |
| 3,308,596 | A | * | 3/1967 | Cooper et al. | 52/630 |
| 3,365,852 | A | * | 1/1968 | Pitillo | 52/636 |
| 3,381,439 | A | * | 5/1968 | Thulin, Jr. | 52/842 |
| 3,820,295 | A | * | 6/1974 | Folley | 52/270 |
| 3,824,664 | A | | 7/1974 | Seeff | |
| 3,902,288 | A | * | 9/1975 | Knudson | 52/86 |
| 3,968,603 | A | * | 7/1976 | Merson | 52/86 |
| 4,006,617 | A | | 2/1977 | Foster | |
| 4,074,495 | A | * | 2/1978 | Bodnar | 52/630 |
| 4,120,123 | A | * | 10/1978 | Knudson | 52/86 |
| 4,228,624 | A | * | 10/1980 | Reneault et al. | 52/145 |
| 4,317,316 | A | * | 3/1982 | Atwood et al. | 52/93.1 |
| 4,365,453 | A | * | 12/1982 | Lowe | 52/478 |
| 4,441,287 | A | * | 4/1984 | Muir | 52/93.2 |
| 4,697,393 | A | * | 10/1987 | Madray | 52/93.2 |
| 4,793,113 | A | * | 12/1988 | Bodnar | 52/481.1 |
| 4,854,104 | A | * | 8/1989 | Pomento | 52/639 |
| 5,036,641 | A | | 8/1991 | Viry | |
| 5,465,487 | A | | 11/1995 | Dean | |
| 5,692,347 | A | | 12/1997 | Hulek | |
| 5,970,672 | A | * | 10/1999 | Robinson | 52/270 |
| 6,293,057 | B1 | * | 9/2001 | Amos Hays | 52/79.1 |
| 6,318,043 | B1 | * | 11/2001 | Johnson | 52/639 |
| 7,647,737 | B2 | | 1/2010 | Morello | |
| 2001/0015047 | A1 | * | 8/2001 | Branson | 52/745.01 |

* cited by examiner

*Primary Examiner* — Phi A
(74) *Attorney, Agent, or Firm* — Ancel W. Lewis, Jr.

(57) ABSTRACT

A metal building system has frame elements covered and connected together by cladding panels. The frame elements have tapered, roll formed wall and roof beams that connect at the wide ends. The cladding panels have large corrugations across most of each panel for rigidity and small corrugations along the edges to allow for roll forming of flanges and for rain drainage. Purlins fastened to the inside of the wall and roof beams connect the frame elements and support insulation panels on the inside of the building system.

19 Claims, 4 Drawing Sheets

METAL BUILDING SYSTEM

TECHNICAL FIELD

The present invention relates to buildings, and more particularly to a building system with frame elements and cladding panels of roll formed light gauge metal.

BACKGROUND ART

Many prior known metal buildings systems are designed and fabricated in-plant as kits for complete buildings of a specified dimension, then packaged and shipped to the distributor and ultimately the end user where the parts are finally assembled at the job site. This assembly process requires heavy cranes to erect relatively heavy steel frames and hundreds of hours to screw fasten the metal sheets onto the purlin structures of these frames. Some of the disadvantages of these prior building practices are that the ultimate user must often order the building well in advance of installation, must absorb high costs in packaging, shipping, and insurance as well as final assembly. Nor do these prior practices provide any opportunity for changes in the final dimension or size in the building. Once ordered, the user cannot readily change an original choice.

Frameless buildings made from arch shaped panels that can be roll formed at the assembly site and seamed together solve many of the above problems of prefabricated building systems. U.S. Pat. No. 3,967,430 to the present applicant, and the related patents, disclose a building system of roll formed, arch shaped panels. However, such frameless building systems are not as suitable for traditional building shapes that have vertical walls and a flat or pitched roof.

U.S. Pat. No. 5,651,230 to the present applicant discloses a metal building system with vertical walls and a pitched roof having a relatively simple frame and cladding panels. The components can be formed on site and the framing jig disclosed is adjustable in size and shape to form buildings of different heights and widths. The framing jig rotates to erect building sections, so that a heavy crane is not required to erect the frame. A building system with fewer frame parts in each frame element will reduce fabrication and assembly costs. Greater cross-section strength in the cladding panels will reduce the number of sections and frame elements required for a building of a given size, and thereby reduce material, fabrication and assembly costs.

DISCLOSURE OF THE INVENTION

A metal building system has a frame covered with a plurality of cladding panels. The frame has a plurality of longitudinally spaced frame elements and a plurality of purlins. Each frame element has two laterally spaced wall beams and two roof beams. The wall and roof beams each have a tapering web with a wide end and a spaced narrow end, and an outer edge and a spaced inner edge. The wall and roof beams have a shaped outer flange along the outer edge of the web and a shaped inner flange along the inner edge of web. The wide end of each roof beam overlaps and connects to the wide end of a wall beam with the roof beams projecting upwardly and inwardly to connect together at the narrow ends. The purlins connect to the inner flange and extend longitudinally between the frame elements. Each frame element may also have a collar beam that extends horizontally between the roof beams and a tie strut that connects the narrow ends of the roof beams, and extends downwardly to the collar beam. The cladding panels each have a wide channel shape with a central portion bordered by first and second side portions that have first and second flanges, respectively. Large corrugations extend across most of central portion while small corrugations extend across the edges of the central portion and across the first and second side portions. The first and second flanges seam with the outer flanges on the wall and roof beams. The purlins have a projecting T element that supports edge grooved, rigid insulation on the interior of the building system.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
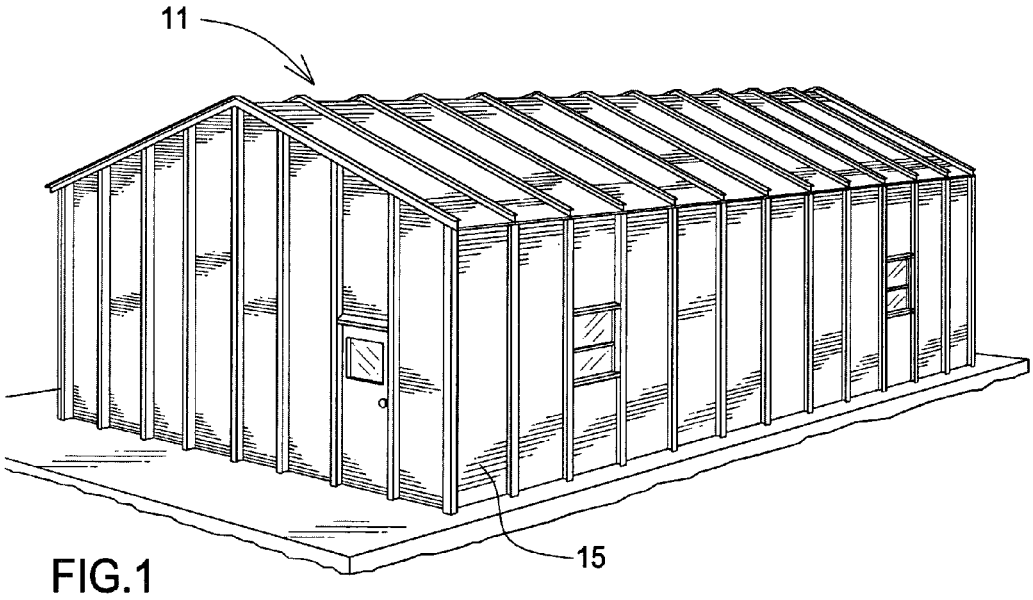
FIG. 1 is a perspective view of a building system embodying features of the present invention.
Figure 2:
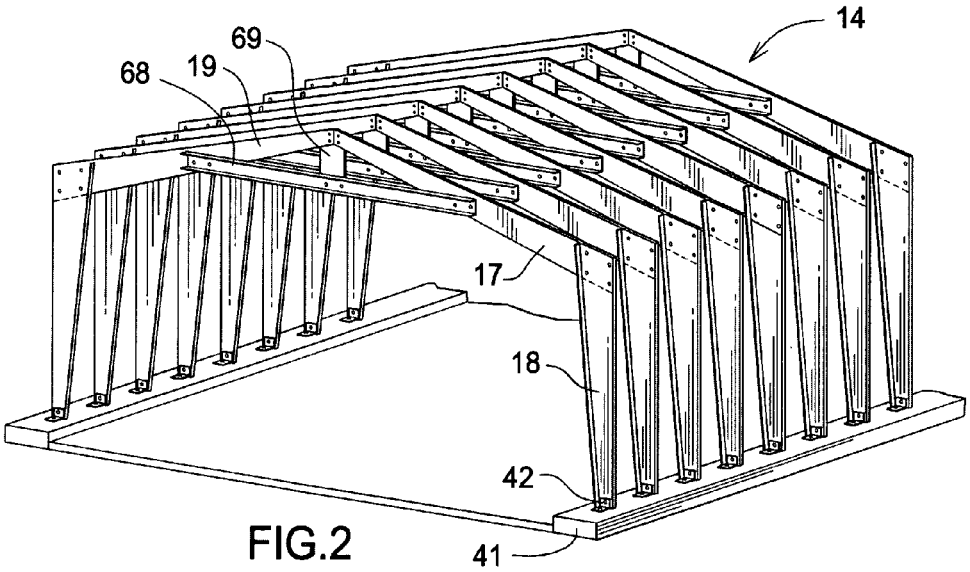
FIG. 2 is a perspective view of the frame of the building system of FIG. 1.
Figure 3:
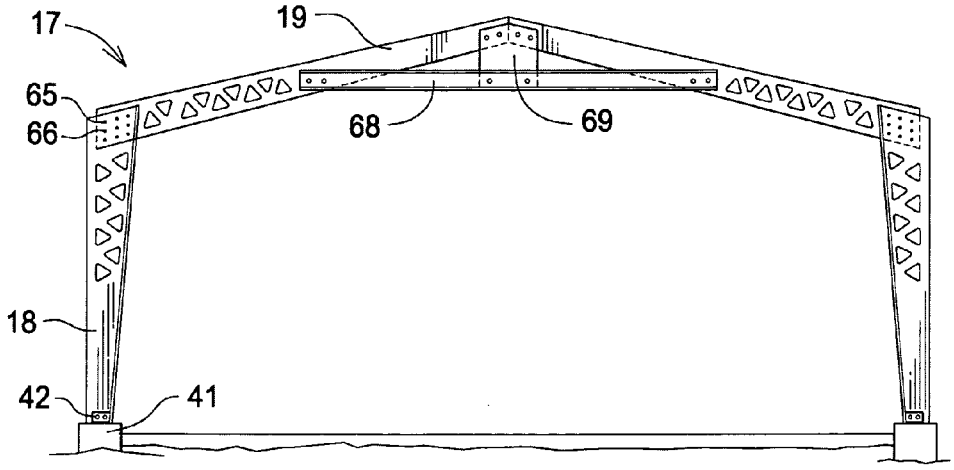
FIG. 3 is a front elevation view of a frame element of the building system of FIG. 1.

Referring to FIGS. 1, 2 and 3, a metal building system 11, embodying features of the present invention, includes a frame 14 and a plurality of cladding panels 15 covering the frame 14. The metal building system 11 shown has a gabled roof with gables at the front and back. The frame 14 includes a plurality of longitudinally spaced frame elements 17.

Describing the specific embodiments herein chosen for illustrating the invention, certain terminology is used which will be recognized as being employed for convenience and having no limiting significance. For example, the terms "lateral" and "longitudinal" will refer to the illustrated embodiment relative to the roof gables being at the front and back. "Outer" and "inner" shall refer to directions relative to the exterior and interior of the illustrated embodiment. "Side edge" with regard to the cladding panels shall refer to the horizontally spaced edges. Further, all of the terminology above-defined includes derivatives of the word specifically mentioned and words of similar import.

Figure 4:
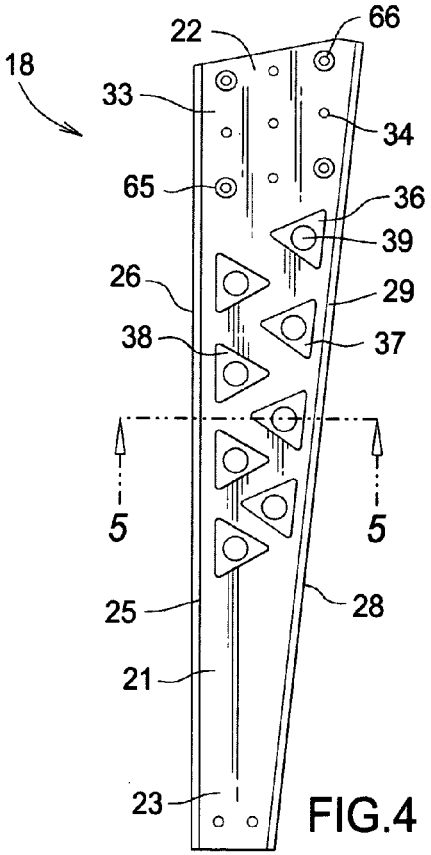
FIG. 4 is a front elevation view of a wall beam of the frame element of FIG. 3.
Figure 5:
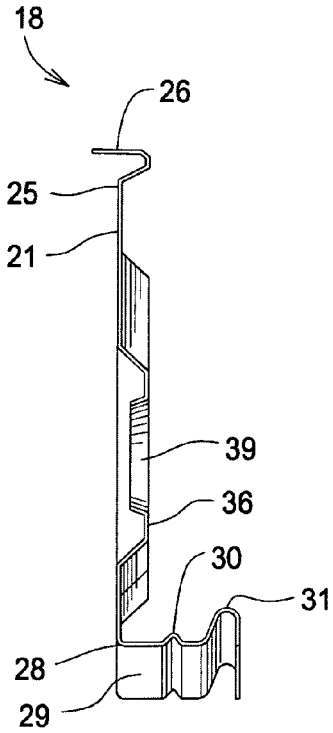
FIG. 5 is a cross sectional view of the wall beam taken along line 5-5 of FIG. 4.

Each frame element 17 includes two wall beams 18 and two roof beams 19. As shown in FIGS. 4 and 5, the wall beams 18 have a web 21 that tapers from a wide end 22 to a narrow end 23. The web 21 has an outer edge 25 with an outer flange 26 that extends from the wide end 22 to the narrow end 23, and an inner edge 28 with an inner flange 29 that extends from the wide end 22 to the narrow end 23. The outer flange 26 has an offset V shape that opens transverse to the web 21. The inner flange 29 projects transversely from the inner edge 28 with an inwardly opening groove 30 and a spaced, outwardly projecting lip 31. The outer and inner flanges 26 and 29 can have other shapes.

The wide end 22 of the web 21 has a pattern 33 of apertures 34. The pattern 33 shown is diamond shaped with nine apertures 34. A diamond pattern 33 will have at least four apertures 34. The pattern 33 can be square, circular or another geometric shape. The web 21 has a plurality of indentations 36 between the wide end 22 and the narrow end 23. The indentations 36 shown are triangular in shape, and are in a pattern 37 of two opposed, alternating, converging rows 38. This pattern 37 provides a bar-joist effect, increasing the rigidity of the wall beam 18. Preferably the indentations 36 are embossed. Each indentation 36 has a relatively large aperture 39 near the center. These apertures 39 relieve stress during forming of the indentations 36 and provides access for conduit elements.

The wall beams 18 of each frame element 17 are laterally spaced apart, and substantially vertical, with the narrow end 23 at the bottom and the wide end 22 at the top. The wall beams 18 generally mount on a foundation 41. The wall beams 18 may be fastened to the foundation 41 with short angle irons 42, as shown in FIGS. 2 and 3, or by other conventional means.

Figure 6:
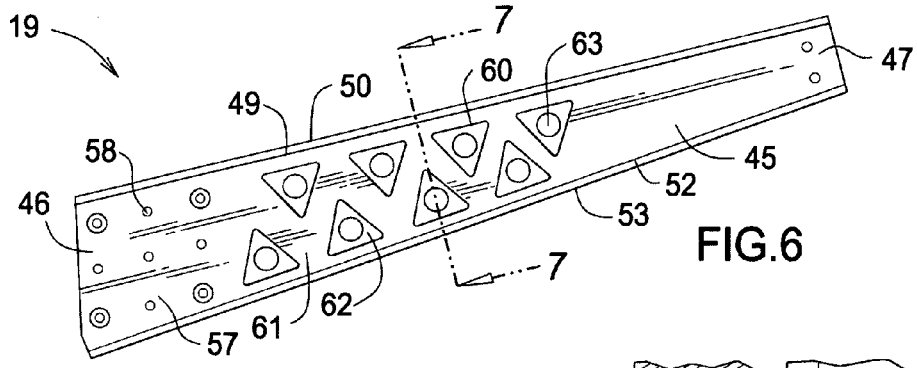
FIG. 6 is a front elevation view of a roof beam of the frame element of FIG. 3.
Figure 7:
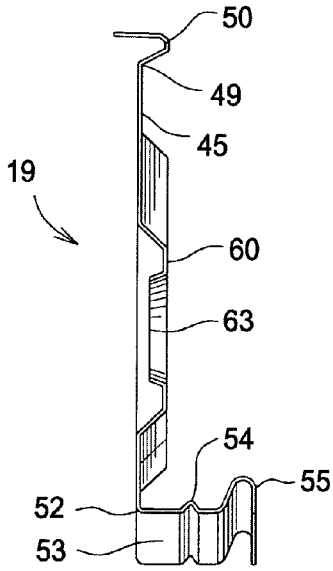
FIG. 7 is a cross sectional view of the roof beam taken along line 7-7 of FIG. 6.

Referring to FIGS. 6 and 7, the roof beams 19 each have a web 45 that tapers from a wide end 46 to a narrow end 47. The web 45 has an outer edge 49 with an outer flange 50 that extends from the wide end 46 to the narrow end 47, and an inner edge 52 with an inner flange 53 that extends from the wide end 46 to the narrow end 47. The outer flange 50 has an offset V shape that opens transverse to the web 46. The inner flange 53 projects transversely from the inner edge 52 with an inwardly opening groove 54 and a spaced, outwardly projecting lip 55. The outer and inner flanges 50 and 53 can have other shapes.

The wide end 46 of the web 45 has a pattern 57 of apertures 58. The pattern 57 shown is diamond shaped with nine apertures 58. A diamond pattern 57 will have at least four apertures 58. The pattern 57 can be square, circular or another geometric shape. The web 45 has a plurality of indentations 60 between the wide end 46 and the narrow end 47. The indentations 60 shown are triangular in shape, and are in a pattern 61 of two opposed, alternating, converging rows 62. This pattern 61 provides a bar-joist effect, increasing rigidity of the roof beam 19. Preferably the indentations 60 are embossed. Each indentation 60 has a relatively large aperture 63 near the center. These apertures 63 relieve stress during forming of the indentations 60 and provides access for conduit elements.

As shown in FIGS. 2 and 3, the wide end 46 of the web 45 of each roof beam 19 overlaps and mounts on the wide end 22 of the web 21 of a wall beam 18, with the roof beam 19 projecting upwardly and inwardly. The pattern 57 of apertures 58 on the web 45 of the roof beam 19 matches the pattern 33 of apertures 34 on the web 21 of the wall beam 18, and the patterns 33 and 57 are positioned to provide a selected pitch or slope for the roof beams 19. Fasteners, such as nuts 65 and bolts 66, through the apertures 34 and 58, fasten the roof beam 19 to the wall beam 18.

Each frame element 17 can also include a collar beam 68 that extends between the roof beams 19 intermediate the wide and narrow ends 46 and 47, and a tie strut 69 that connects the narrow ends 47 together and extends downwardly to connect to the collar beam 68. The collar beam 68 can be a roll formed, C shaped strut and the tie strut 69 can be a wide, roll formed, C shaped section. Additional truss struts may be added as necessary in wider buildings with longer roof beams 19.

Figure 8:
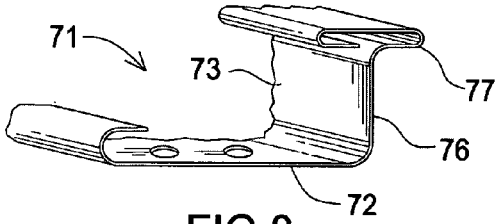
FIG. 8 is a partial perspective view of a purlin of the building system of FIG. 1.
Figure 9:
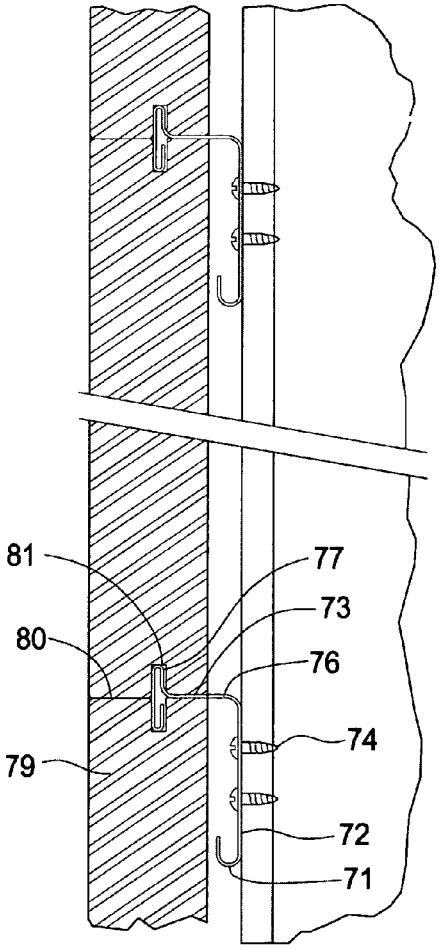
FIG. 9 is a partial front elevation view of a roof beam of the frame element of FIG. 3 with purlins supporting insulation panels.
Figure 10:
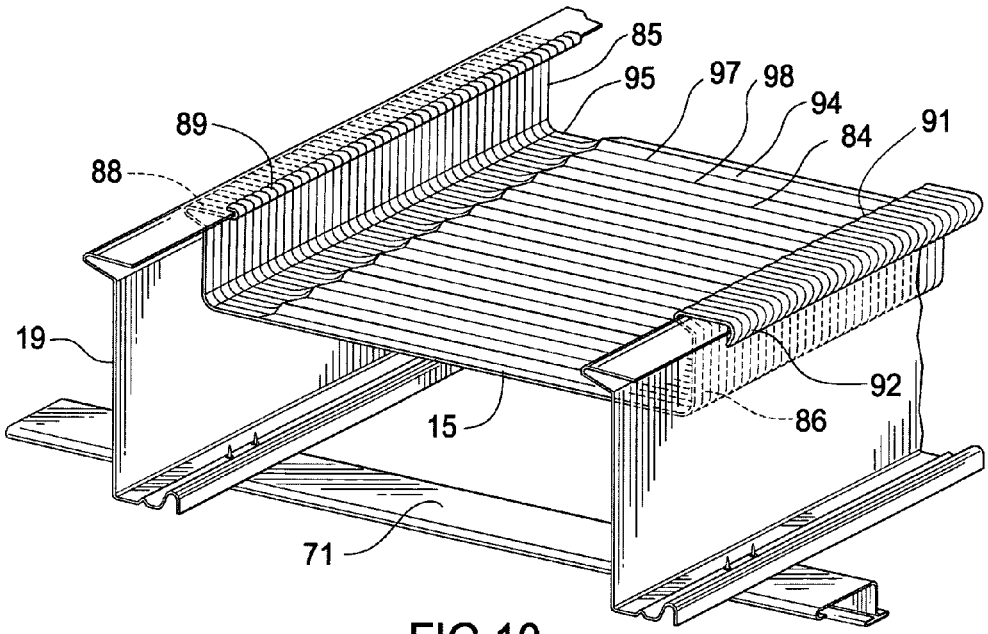
FIG. 10 is a perspective view of a cladding panel and a purlin on a pair of the roof beams of FIG. 6.

Referring to FIGS. 8, 9 and 10, the frame 14 also includes a plurality of longitudinally extending, spaced purlins 71 that fasten to the inner flanges 29 and 53 of the wall and roof beams 18 and 19, and the bottom of the collar beam 68. Each purlin 71 has a substantially flat mounting portion 72 and a T shaped element 73 that projects transversely from the mounting portion 72. The mounting portion 72 is attached to the inner flange 29 of the wall beams 18 or the inner flange 53 of the roof beams 19, or the bottom of the collar beams 68, with screws 74, with the T shaped element 73 projecting inwardly. Each T shaped element 73 has a base 76 the extends from the mounting portion 72 and a pair of oppositely projecting arms 77 transverse to the base 76 and spaced from the mounting portion 72. The building system 11 can include rigid insulation panels 79. The insulation panels 79 have edges 80 with grooves 81 that are sized and shaped to receive the arms 77 of the T shaped elements 73. The purlins 71 support the insulation panels 79 to provide a smooth, even, prefinished building interior with minimal thermal transfer. The purlins 71 also add longitudinal support to the frame 14.

Figure 11:
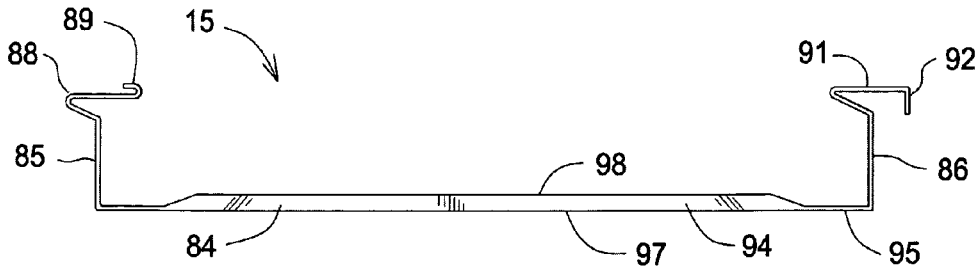
FIG. 11 is an end profile view of the cladding panel of FIG. 10.

As shown in FIGS. 10 and 11, the cladding panels 15 have a wide channel shape. Each cladding panel 15 includes a central portion 84, a first side portion 85 that projects transversely outwardly from one edge of the central portion 84 and a spaced second side portion 86 that projects transversely outwardly from the opposite edge of the central portion 84. The first side portion 85 has a first flange 88 spaced opposite the central portion 84. The first flange 88 is sized and shaped to mate with the outer flanges 26 and 50 on the wall and roof beams 18 and 19. The first flange 88 has an offset V shape that fits inside the offset V shape of the outer flanges 26 and 50 on the wall and roof beams 18 and 19 and a hook 89 that curves around outside the outer flanges 26 and 50 on the wall and roof beams 18 and 19.

The second side portion 86 has a second flange 91 spaced opposite the central portion 84. The second flange 91 is sized and shaped to mate with the outer flanges 26 and 50 on the wall and roof beams 18 and 19, and the first flange 88. The second flange 91 has an offset V shape that fits over the offset V shape of the outer flanges 26 and 50 on the wall and roof beams 18 and 19 and over the hook 89 on the first flange, and a lip 92 that projects inwardly from the V shape. The first flange 88 on one cladding panel 15, the second flange 91 on the next cladding panel, and the outer flange 26 or 50 on a wall or roof beam 18 or 19 are seamed together by bending or folding the lip 92 inwardly towards the inside of the V shape of the first flange 88.

Each cladding panel 15 is corrugated with large corrugations 94 that extend horizontally across most of the central portion 84. The ends of the large corrugations 94 are spaced inwardly from the first and second side portions 85 and 86. Each cladding panel 15 is corrugated with small corrugations 95 that extend horizontally along the central portion 84 from the large corrugations 94 to the first side portion 85 and outwardly along the first side portion 85. Each cladding panel 15 is corrugated with small corrugations 95 that extend horizontally along the central portion 84 from the large corrugations 94 to the second side portion 86 and outwardly along the second side portion 88.

The large corrugations 94 have valleys 97 and peaks 98, with the valleys 97 being even with the small corrugations 95 on the central portion 84 and the peaks 98 projecting outwardly relative to the small corrugations 95 on the central portion 84, so that when the cladding panels 15 are mounted on the roof beams 19, rain drains out of the valleys 97 and down the small corrugation 95. The large corrugations 94, in combination with the purlins 71, provide longitudinal rigidity to the building system 11. The large corrugations 94 allow greater spacing between frame elements 17 and therefore the use of fewer frame elements 17 than would be possible without corrugated panel. The small corrugations 95 balance stress and shrinkage from forming the large corrugations 94, and allow the first and second side portions 85 and 86, and the first and second flanges 88 and 91 to be roll formed.

Preferably the cladding panels 15, wall beams 18, roof beams 19, collar beams 68, tie struts 69 and purlins 71 are roll formed from light gauge metal. The cladding panels 15, wall beams 18, roof beams 19, collar beams 68, tie struts 69 and purlins 71 can be roll formed from steel coils of galvanized or prefinished stock. The cladding panels 15, wall beams 18, roof beams 19, collar beams 68, tie struts 69 and purlins 71 can be roll formed at the assembly site or at a factory. The wall beams 18 and roof beams 19 stack together for shipping. The hip joint between the wide ends 22 and 46 of the wall and roof beams 18 and 19 provides a stronger joint than would provided with non-tapered beams. The metal building system 11 is simpler and has fewer parts than prior known systems. The metal building system 11 reduces fabrication time and cost, assembly time and material cost relative to prior known gabled metal buildings with vertical walls.

Although the present invention has been described with a certain degree of particularity, it is understood that the present disclosure has been made by way of example and that changes in details of structure may be made without departing from the spirit thereof.

What is claimed is:

1. A metal building system comprising:

a plurality of longitudinally spaced frame elements each including two laterally spaced wall beams and two roof beams, each of said wall and roof beams having a tapering web with a wide end and a spaced narrow end, and an outer edge and a spaced inner edge, each of said wall and roof beams having a shaped outer flange along said outer edge of said web and shaped inner flange along said inner edge of said web, said wide end of said web of each said roof beam overlapping and connecting to said wide end of said web of one of said wall beams with said roof beams projecting upwardly and inwardly and being connected together at said narrow ends of said web, and cladding panels extending between said wall beams and between said roof beams of consecutive said frame elements, and mating with and being seamed to said outer flange on said wall beams and said roof beams, whereby said frame elements provide lateral rigidity and said cladding panels provide longitudinal rigidity.

2. The system as set forth in claim 1 including a plurality of vertically spaced, longitudinally extending purlins connected to said inner flange of said wall beams, and a plurality of vertically and laterally spaced, longitudinally extending purlins connected to said inner flange of said roof beams, whereby said purlins provide additional longitudinal rigidity.

3. The system as set forth in claim 2:

wherein each said purlin includes an inwardly projecting T shaped element, and including rigid insulation panels having edge grooves sized and shaped to receive said T element, whereby said purlins support said insulation panels.

4. The system as set forth in claim 1 wherein said frame elements each include a collar beam connected to and extending horizontally between said roof beams.

5. The system as set forth in claim 4 wherein said frame elements each include a tie strut that connects said narrow ends of said web of said roof beams, and extends downwardly from said narrow ends of said web of said roof beams and connects to said collar beam.

6. The system as set forth in claim 1 wherein said wide ends of said web of said wall and roof beams each have a precisely positioned, matching pattern of apertures, and said frame elements have a plurality of fasteners that extend through said apertures to connect said wide ends of said web of said wall and roof beams, said pattern being positioned to provide a selected pitch to said roof beams.

7. The system as set forth in claim 6 wherein said pattern is diamond shaped and includes at least four apertures.

8. The system as set forth in claim 7 wherein said pattern includes nine apertures.

9. The system as set forth in claim 1 wherein said wall and roof beams each include a pattern of embossed indentations between said wide and narrow ends of said web, whereby said indentations increase the rigidity of said wall and roof beams.

10. The system as set forth in claim 9 wherein said indentations are generally triangular and said pattern includes opposed, alternating, converging rows of said indentations.

11. The system as set forth in claim 9 wherein said indentations each include a relatively large center aperture that relieves stress during forming of said indentations and provides access for conduit elements.

12. The system as set forth in claim 1 wherein:

said outer flange on said wall and roof beams has an offset V shape transverse to said web, and said cladding panels each include a first flange shaped to extend into said outer flange on one of said frame elements and a spaced second flange shaped to wrap around said outer flange on a consecutive said frame element, whereby said first, second and outer flanges are seamed together to connect together said frame elements and said cladding panels.

13. The system as set forth in claim 1 wherein said cladding panels each have a wide channel shape with a central portion bordered by outwardly projecting, transverse, spaced first and second side portions, said first side portion having a first flange opposite said central portion, and sized and shaped to mate with said outer flange on said wall and roof beams, said second side portion having a second flange opposite said central portion, and sized and shaped to mate with said outer flange on said wall and roof beams and said first flange.

14. The system as set forth in claim 13 wherein said cladding panels include a plurality of large corrugations extending across said central portion, said large corrugations being spaced inwardly from said first and second side portions, whereby said large corrugations provide longitudinal rigidity.

15. The system as set forth in claim 14 wherein said large corrugations have peaks and valleys with said valleys being formed even with said central portion between said large corrugations and said first and second side portions, and said peaks being formed to project outwardly relative to said central portion between said large corrugations and said first and second side portions, whereby, when said cladding panels are mounted on said roof beams, rain falling on said large corrugations flows out of said valleys and down said central portion between said large corrugations and said first and second side portions.

16. The system as set forth in claim 14 wherein said cladding panels include a plurality of small corrugations extending from said large corrugations to said first and second side portions and along said first and second side portions, whereby said small corrugations balance stress and shrinkage from forming said large corrugations.

17. The system as set forth in claim 1 wherein said wall and roof beams, and said cladding panels are made from light gauge metal.

18. The system as set forth in claim 1 wherein said wall and roof beams, and said cladding panels are roll formed.

19. A metal building system comprising:

a plurality of longitudinally spaced frame elements each including two laterally spaced wall beams, two roof beams, a collar beam and a tie strut, each of said wall and roof beams having a tapering web with a wide end and a spaced narrow end, and an outer edge and a spaced inner edge, each of said wall and roof beams having a shaped outer flange along said outer edge of said web and shaped inner flange along said inner edge of said web, said wide end of said web of each said roof beam overlapping and connecting to said wide end of said web of one of said wall beams with said roof beams projecting upwardly and inwardly, said collar beam being connected to and extending horizontally between said roof beams, said tie strut connecting said narrow ends of said web of said roof beams, and extending downwardly from said narrow ends of said web of said roof beams and connecting to said collar beam, a plurality of vertically spaced, longitudinally extending purlins connected to said inner flange of said wall beams, and a plurality of vertically and laterally spaced, longitudinally extending purlins connected to said inner flange of said roof beams, and cladding panels extending between said wall beams and between said roof beams of consecutive said frame elements, said cladding panels each have a wide channel shape with a central portion bordered by outwardly projecting, transverse, spaced first and second side portions, said first side portion having a first flange opposite said central portion, and sized and shaped to mate with said outer flange on said wall and roof beams, said second side portion having a second flange opposite said central portion, and sized and shaped to mate and seam with said outer flange on said wall and roof beams and said first flange, whereby said frame elements provide lateral rigidity, and said purlins and said cladding panels provide longitudinal rigidity.

* * * * *